United States Patent [19]

Newkirk et al.

[11] 4,094,797

[45] June 13, 1978

[54] OXIDATION STABLE FIBER LUBRICANT

[75] Inventors: David Dudley Newkirk; Robert Bernard Login, both of Woodhaven; Basil Thir, Wyandotte, all of Mich.

[73] Assignee: BASF Wyandotte Corporation, Wyandotte, Mich.

[21] Appl. No.: 820,405

[22] Filed: Aug. 1, 1977

[51] Int. Cl. ..... D06m 13/10

[52] U.S. Cl. ..... 252/8.9; 8/115.6; 260/410.5; 260/613 B; 560/254

[58] Field of Search ..... 252/8.9; 8/115.6 A; 260/613 B, 410.5; 560/254

[56] References Cited

U.S. PATENT DOCUMENTS

| | | | |
|---|---|---|---|
| 2,677,700 | 5/1954 | Jackson et al. | 260/613 B |
| 3,146,272 | 8/1964 | Lloyd | 260/611.5 |
| 3,475,499 | 10/1969 | Winnick | 260/615 |
| 3,578,594 | 5/1971 | Dombrow | 252/8.9 |

*Primary Examiner*—William E. Schulz
*Attorney, Agent, or Firm*—Andrew E. Pierce; Robert E. Dunn; Bernhard R. Swick

[57] ABSTRACT

There are disclosed oxidation stable heteric or block copolymer polyoxyalkylene compositions suitable for the treatment of thermoplastic fibers, particularly polyester and nylon fibers, prior to the processing of such fibers in conventional processes to impart false twist, or to produce textured yarn or other type yarns by mechanical heat treatment and tensioning processes. The polyoxyalkylene compounds of the invention derived from lower alkylene oxides can be initiated with a difunctional aromatic compound containing reactive hydrogens such as a dihydroxyphenol to obtain an aromatic nucleus in the polymer chain and are capped on at least one end of the chain with an alpha-olefine epoxide or mixtures thereof with at least one aliphatic monocarboxylic acid. Hydroxyl functionality can be retained on one end of the molecule.

Alternatively, the polyoxyalkylene compounds of the invention can be derived from the polymerization of at least one lower alkylene oxide in admixture with an aromatic glycidyl ether wherein said polyoxyalkylene compound is produced by initiation of the polymerization with a base compound having one or more active hydrogen atoms and followed by end capping the chain of the polyoxyalkylene compound by reaction with an alpha-olefin epoxide or mixtures thereof with at least one aliphatic monocarboxylic acid.

In addition to the use of the oxidation stable polyoxyalkylene fiber lubricants of the invention alone or in admixtures with each other, said lubricants can be utilized in combination with fiber lubricants of the prior art wherein said mixtures contain a minor proportion of the oxidation stable fiber lubricants of the invention.

22 Claims, No Drawings

OXIDATION STABLE FIBER LUBRICANT

BACKGROUND OF THE INVENTION

1. Field of the Invention

This invention relates to lubricants for synthetic fibers such as mono- and multi-filament polyester and nylon yarn and particularly to lubricants having improved resistance to oxidation at elevated temperatures of at least over 200° C.

2. Description of the Prior Art

Yarns produced from synthetic thermoplastic fibers such as polyesters and polyamides require mechanical and heat treatment to produce the so-called "bulky" yarns, false twist or textured yarns. Since the thermo-mechanical treatment required is of necessity performed as the yarn is travelling at high speed, such processes are facilitated by the application to the yarn, prior to processing, of a lubricating composition. Besides imparting lubricity to the yarn, the lubricant often provides desirable antistatic properties, and emulsification properties. Upon the conclusion of the thermo-mechanical treatment of the yarn, the lubricant should be easily removed by scouring.

In the thermo-mechanical treatment of the yarn, temperatures in the range of 180° to 250° C are often encountered. Therefore, the lubricating agent must be resistant to oxidative degradation and must not volatilize to a substantial degree during such processing. Conventional lubricants for synthetic thermoplastic textile fibers generally suffer from a lack of resistance to oxidation as indicated by the fact that such lubricants exhibit excessive fuming when exposed to temperatures of at least above 200° C and often tar-like, resinous materials derived from such lubricant accumulate on heated plates, utilized in the thermo-mechanical treatment of the yarn, which come in contact with the yarn during such processing.

Since thermo-mechanically treated fiber is often stored over prolonged periods of time prior to the removal of fiber lubricants, not only must the lubricant be oxidation stable but, in addition, must resist discoloration upon exposure to oxides of nitrogen often present in the air especially in industrial locations.

While various antioxidants have been added to polyoxyalkylene compounds utilized as fiber lubricants to protect these compounds against oxidative degradation at elevated temperatures, such antioxidants are generally susceptible to discoloration upon exposure to oxides of nitrogen and thus many such compounds are not useful as components of fiber lubricants.

Antioxidants for polyoxyalkylene compounds are disclosed in U.S. Pat. No. 3,146,272 wherein there is disclosed the use of various monofunctional phenolic compounds as initiators in the production of polyoxyalkylene compounds. These compounds are then utilized in admixture with other polyoxyalkylene compounds susceptible to oxidative deterioration. Compounds such as phenothiazine, phenol and alkylated phenols are disclosed. A bisphenol A bis(propylene glycol) ether dilaurate is disclosed as a component of a stabilized lubricant for nylon and polyester fibers in Japanese 76-70,397. The use of a difunctional phenol such as resorcinol as an initiator in the preparation of polyoxypropylene surfactants is disclosed in U.S. Pat. Nos. 2,674,619 and 3,036,118; the use of aromatic substituted alkylene oxides as initiators in the production of polyoxyalkylene polymers is disclosed in U.S. Pat. No. 2,677,700 and the use of terminal di-vic-epoxides in the production of linear thermoplastic polyether resins based upon bisphenols is shown in U.S. Pat. No. 3,637,590. Such resins are characterized by high impact resistance suitable for use where polycarbonates have been used in the past. Epoxy alkane reactants having terminal epoxide groups are disclosed in U.S. Pat. No. 3,240,819 as useful in the preparation of surfactant compositions by reaction with ethylene glycol. Alpha-olefin epoxides are also disclosed in U.S. Pat. No. 3,475,499 for use as reactants with water or a glycol to produce biodegradable detergents.

In none of these references are the oxidation stable fiber lubricants of this invention disclosed or suggested. Accordingly, it is an object of the invention to provide to the art oxidation stable polyoxyalkylene compounds which are not discolored by exposure to an atmosphere containing oxides of nitrogen and are useful as lubricants for synthetic thermoplastic fibers such as polyester and nylon fibers.

SUMMARY OF THE INVENTION

Oxidation stable heteric or block copolymer polyoxyalkylene compounds are disclosed which are useful either alone or in admixture with other prior art polyoxyalkylene compounds which are susceptible to oxidative degradation. The polyalkylene compounds are useful as lubricants for synthetic thermoplastic textile fibers such as polyamide and nylon fibers.

The polyoxyalkylene compound lubricants of the invention can be based upon capped block or heteric adducts of lower alkylene oxides initiated using a dihydroxyphenol. Such compounds have a cap on at least one end of the molecule derived from the residue of an alpha-olefin epoxide or mixtures thereof with a monocarboxylic acid. The other end of the molecule can retain hydroxyl functionality. The polyoxyalkylene compounds of the invention are useful as thermoplastic textile fiber lubricants having improved resistance to oxidation and unexpectedly show resistance to yellowing upon exposure to oxides of nitrogen. The resistance to oxidation is indicated by a reduced tendency to generate smoke upon exposure to typical fiber processing temperatures encountered during treatment of the fiber to produce false twist or textured yarn.

Alternatively, the polyoxyalkylene compound lubricants of the invention are capped block or heteric adducts of a mixture of lower alkylene oxides and an aromatic substituted glycidyl ether, said polymers being initiated using a base compound having one or more active hydrogen atoms and capped using an alpha-olefin epoxide or mixtures thereof with a monocarboxylic acid. Such compounds are novel lubricants for synthetic thermoplastic textile fibers unexpectedly showing improved resistance to oxidation as indicated by a reduced tendency to generate smoke upon exposure to elevated temperatures and also unexpectedly do not yellow upon exposure to oxides of nitrogen. Combinations of the fiber lubricants of the prior art with either or both of the above polyoxyalkylene compounds present in a proportion of at least about 25 percent by weight provide improved oxidation stable fiber lubricants.

DETAILED DESCRIPTION OF THE INVENTION AND THE PREFERRED EMBODIMENTS

The textile fiber lubricants of the invention are heteric or block polymers and have the following generalized structure:

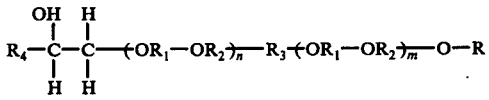

I

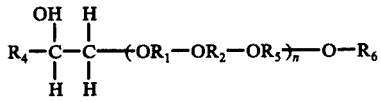

II wherein R is selected from the group consisting of hydrogen, an alkyl group derived from the residue of an aliphatic monocarboxylic acid having 1 to about 24 carbon atoms, preferably about 8 to about 20 carbon atoms,

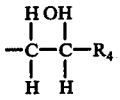

and mixtures thereof; $R_1$ and $R_2$ are derived from the same or different lower alkylene oxides selected from the group consisting of ethylene oxide, 1,2-propylene oxide and butylene oxide; $R_3$ is the residue of at least one dihydroxyphenol; $R_4$ is an alkyl group, having 1 to about 22 carbon atoms, preferably about 4 to about 18 carbon atoms and most preferably about 6 to about 12 carbon atoms; and $R_5$ is the residue of at least one aromatic glycidyl ether, preferably phenyl glycidyl ether, and $R_6$ is selected from the group consisting of hydrogen, an alkyl group derived from the residue of an aliphatic monocarboxylic acid having 1 to about 24 carbon atoms, preferably about 8 to about 20 carbon atoms, an alkyl group derived from the residue of an aliphatic alcohol having about 1 to about 24 carbon atoms, preferably about 8 to about 20 carbon atoms,

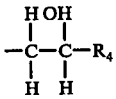

and mixtures thereof; and $n$ or $n + m$ is such that the compound has a molecular weight of about 300 to about 3000, preferably about 600 to about 2000 and most preferably about 800 to about 1800.

Representative aliphatic monocarboxylic acids are: acetic, propionic, butyric, trimethylacetic, α-methylbutyric, isobutyric, valeric, isovaleric, lauric, caprylic, caproic, capric, myristic, palmitic, stearic, oleic, linoleic and the like.

Representative aliphatic alcohols are: methanol, ethanol, propanol, isopropanol, butanol, secondary butanol, tertiary butanol, 3-methyl-2-butanol, 3-buten-2-ol, n-amyl alcohol, isopentyl, n-hexyl, n-heptyl, n-octyl, n-decyl, n-dodecyl, n-tetradecyl, n-hexadecyl, n-octadecyl, the monomethyl ether of diethylene glycol, 2-chloroethanol, allyl and crotyl alcohols and methylvinylcarbinol.

Structural formula I is prepared by first forming an intermediate heteric or block copolymer having the type formula:

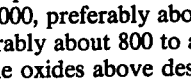

wherein: $R_1$ and $R_2$ are the same or different lower alkylene oxides preferably selected from the group consisting of ethylene oxide, 1,2-propylene oxide and butylene oxide; $R_3$ is at least one dihydroxyphenol and $m + n$ is such that the compound has a molecular weight of about 300 to about 3000, preferably about 600 to about 2000 and most preferably about 800 to about 1800. Reaction of the alkylene oxides above described with difunctional aromatic compounds containing reactive hydrogens such as a dihydroxyphenol can be such that block or heteric polyoxyalkylene compounds are produced by procedures well known to those skilled in the art. Where the most preferred reactants, ethylene oxide and 1,2-propylene oxide are used in Structural formulas I and II, the weight ratio of these components is respectively about 90:10 to about 10:90, preferably about 80:20 to about 20:80 and most preferably about 75:25 to about 25:75. The terminal hydroxyl groups of the above defined polymeric compound can be used as sites for further reaction with an alpha-olefin epoxide having about 3 to about 24 carbon atoms, preferably about 6 to about 20 carbon atoms in the chain or with mixtures thereof and an aliphatic monocarboxylic acid.

Alternatively, oxidation stable fiber lubricants of the invention corresponding to structural formula II can be produced by block or heteric polymerization to produce a polyoxyalkylene compound from a mixture of lower alkylene oxides selected from the group consisting of ethylene oxide, propylene oxide and butylene oxide in combination with at least one aromatic glycidyl ether wherein, as an initiator at least one base compound having one or more active hydrogen atoms is utilized, as previously described. An intermediate compound is first produced having the formula:

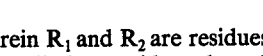

wherein $R_1$ and $R_2$ are residues of the same or different lower alkylene oxides selected from the group consisting of ethylene oxide, propylene oxide and butylene oxide; $R_5$ is the residue of at least one aromatic glycidyl ether; $R_6$ is , as previously described, selected from the group consisting of hydrogen, the residue of an aliphatic monocarboxylic acid, an aliphatic alcohol,

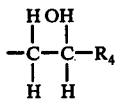

and mixtures thereof; and $n$ is such that the compound has a molecular weight of about 300 to about 3000, preferably about 600 to about 2000 and most preferably about 800 to about 1800. Where the most preferred reactants, ethylene oxide and 1,2-propylene oxide, are used in structural formula II, the weight ratio of $R_5$ to the sum of $R_1$, $R_2$ and $R_5$ is respectively about 5:95 to about 40:60; preferably about 10:90 to about 20:80 and most preferably about 10:90 to about 15:85.

The aromatic glycidyl ether designated $R_5$ in the above formula intermediate is an aromatic substituted alkylene oxide having up to about 6 carbon atoms, preferably up to about 3 carbon atoms in the alkyl group such as phenyl glycidyl ether. Additional examples of useful aromatic substituted alkylene oxides are as follows: para-methoxyphenyl glycidyl ether, para-chlorophenyl glycidyl ether and para-methylphenyl glycidyl ether.

The terminal hydroxyl groups of the above defined polymeric intermediate compound are used as sites for further reaction with an alpha-olefin epoxide or mixtures thereof with an aliphatic monocarboxylic acid, said epoxide having from about 3 to about 24 carbon atoms, preferably about 6 to about 20 carbon atoms to produce Structure II. The alpha-olefin epoxides can be obtained by epoxidation of normal alpha-olefins by reaction with an organic hydroperoxide in the presence of a catalyst in accordance with procedures known in the prior art as described in U.S. Pat. No. 3,475,499, incorporated herein by reference. For instance, tertiary butyl hydroperoxide is reacted with a normal alpha-olefin in the presence of a metallic catalyst such as molybdenum naphthenate to produce an alpha-olefin epoxide. The reaction is conducted by placing the required amount of catalyst and normal alpha-olefin in a reaction vessel wherein the temperature is controlled at 90° C. The organic hydroperoxide is added to this mixture in a continuous fashion over an 8-hour period. After the reaction is complete, the mixture is cooled to about 25° C and distilled under reduced pressure (50 millimeters of mercury) to purify the product.

The alpha-olefin epoxides, or epoxyalkanes, can be represented by the generalized structural formula:

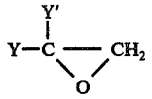

wherein Y' is hydrogen and Y is an alkyl radical having about 1 to about 22 carbon atoms, preferably about 4 to about 18 carbon atoms. The carbon atoms of the alkyl radicals may be arranged in either a straight-chain or a branched-chain configuration. Illustrative examples of some suitable alkyl radicals include the methyl, ethyl, butyl, isohexyl, 2-ethylhexyl, isononyl, n-dodecyl, tert-dodecyl, 2-propylheptyl, 5-ethylnonyl, 2-butyloctyl, n-tetradecyl, n-pentadecyl, tert-octadecyl, 2,6,8-trimethylnonyl, and 7-ethyl-2-methyl-4-undecyl radicals. An especially valuable class of epoxides is derived from epoxidation of olefins formed either by polymerization of olefin monomers or by dehydration of the alcohols derived from an olefin monomer, dimer, trimer, tetramer, pentamer, or the like, carbon monoxide and hydrogen by the "Oxo" process.

Illustrative examples of some epoxides which can be used as reactants in the process of this invention are as follows: 1,2-epoxyoctane, 1,2-epoxydecane, 1,2-epoxydodecane, 1,2-epoxytetradecane, 1,2-epoxyhexadecane, 1,2-epoxyoctadecane, 1,2-epoxyeicosane, and 1,2-epoxytetracosane.

The difunctional aromatic compound containing reactive hydrogens as exemplified by the dihydroxyphenols can be mononuclear or polynuclear. Representative examples of mononuclear dihydroxyphenols are resorcinol, catechol, and hydroquinone. Representative examples of polynuclear dihydroxyphenols are 2,2'-bis(4'-hydroxyphenyl)propane, 2,2'-bis(4-hydroxyphenyl)butane, 2,6-dihydroxynaphthalene and 1,4-dihydroxynaphthalene.

Other useful difunctional aromatic compound initiators containing at least two active hydrogen atoms capable of reacting with an alkylene oxide are the aromatic difunctional alcohols, i.e., diols, aromatic dicarboxylic acids, aromatic amines, aromatic amides, aromatic mercaptans, aromatic sulfonamides and other aromatic compounds having at least two active hydrogens as part of the molecule. The difunctional aromatic compound initiators of the invention can be substituted with other groups which do not contain an active hydrogen capable of reacting with an alkylene oxide such as alkyl, halogen, nitrate, alkoxy, etc.

The useful alkylene oxides are preferably lower alkylene oxides selected from the group consisting of ethylene oxide, 1,2-propylene oxide and 1,2-butylene oxide. Generally useful alkylene oxides have the formula:

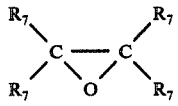

wherein $R_7$ can be the same or different and is selected from the group consisting of hydrogen and aliphatic radicals having about 2 to about 8 carbon atoms in the chain as exemplified by ethylene oxide, propylene oxide, n-butylene oxide, hexylene oxide and octylene oxide. Preferably said aliphatic radical has about 2 to about 3 carbon atoms in the chain.

In the production of the polyoxyalkylene polymers of the invention which are useful as synthetic thermoplastic fiber lubricants, it will be appreciated that in all instances a mixture of various molecular weight polymers results and that molecular weights given throughout this application are average values.

The preparation of the heteric or block polymer intermediates of the invention by the reaction of the lower alkylene oxides using a dihydroxyphenol as an initiator is more fully described in U.S. Pat. Nos. 2,674,619 and 3,036,118, hereby incorporated by reference. The preparation of polyoxyalkylene compounds from aliphatic acids such as formic, acetic, butyric acids and the like are described in U.S. Pat. No. 2,677,700, incorporated herein by reference.

Fiber lubricants based upon mixtures or blends of oxidation-susceptible polyoxyalkylene lubricant compounds, including heteric or block polymers, and other lubricant compounds known in the prior art with the oxidation stable lubricants of the invention, as disclosed in structural formulas I and II, can be prepared. Such blends show substantially improved resistance to oxidative deterioration where they contain a proportion of at least about 25% by weight of the oxidation stable polyoxyalkylene lubricant compounds of the invention together with the polyoxyalkylene lubricant compounds of the prior art. Representative prior art lubricants useful in said blends comprise alkylated amines, amides and alcohols as well as compositions based upon mineral oil, coconut oil and similar glycerides. Useful fiber lubricants of the prior art are represented by the generalized structural formulas:

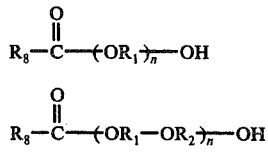

-continued

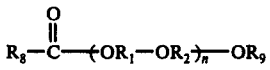

wherein $R_8$ is an alkyl group having about 7 to about 24, preferably about 12 to about 18 carbon atoms, $R_9$ is an alkyl or acyl group having 1 to about 22 carbon atoms, preferably about 4 to about 18 carbon atoms and most preferably about 6 to about 12 carbon atoms, and $R_1$, $R_2$, and $n$ are as previously defined. While it will be appreciated that under certain conditions lubricant blends can be prepared under which satisfactory inhibition of oxidation results which contain as little as 25 percent by weight of the oxidation stable lubricant of the invention, under severe conditions of prolonged exposure to high temperatures and to air, 50 percent by weight or more of the oxidation stable lubricants of the invention may be required.

It is believed that the oxidative deterioration of polyoxyalkylene compounds is accompanied by the formation of carbonyl compounds, peroxides and acids and that the manifestation of such deterioration is the formation of color. Often a decrease in viscosity occurs with the concordant formation of volatile by-products as indicated by the fuming of the composition at elevated temperature. Thus, the tendency to smoke or fume of polyoxyalkylene textile lubricants upon their use at elevated temperatures such as about 200° C is commonly utilized as an indicator of oxidation stability of the compound. Thermo-gravimetric analysis is also commonly used in the laboratory to evaluate oxidation stability of such products. For instance, the oxidative stability of the oxidation stable polyoxyalkylene products of the invention was evaluated by utilizing a Du-Pont Model 990 Thermo-Analyzer. In these test procedures, a gas flow rate of 50 milliliters per minute and a rate of heating of 10° C per minute was utilized.

The fiber lubricants of the invention can be applied to synthetic thermoplastic fibers in any conventional spin-finish process or in other finishing processes available in the prior art. Any suitable polyester or nylon filament or other high tenacity synthetic thermoplastic yarn known in the prior art can be used. While the polyesters preferred for the production of fibers are the linear terephthalic polyesters, that is, the polyesters of a glycol containing about 2 to about 20, preferably about 2 to about 12 carbon atoms and a dicarboxylic acid component containing at least about 75 percent by weight terephthalic acid, polyesters containing other suitable dicarboxylic acid such as sebacic acid, adipic acid, isophthalic acid, sulfonyl-4, 4'-dibenzoic acid or 2,8-dibenzofuran dicarboxylic acid can be used.

Representative glycols useful in preparing the polyester fibers are: ethylene glycol, diethylene glycol, butylene glycol, decamethylene glycol and bis(1,4-hydroxymethyl) cyclohexane. Examples of linear terephthalate polyesters which can be employed include poly(ethylene terephthalate) and poly(butylene terephthalate).

Any suitable nylon which provides high tenacity yarn can be used in combination with the lubricants of the invention to produce false twist or high bulk yarn. The preferred nylon polymers are the linear polyamides including poly(hexamethylene adipimide) and poly(caprolactam).

Usually the treating agent of the invention is applied to the synthetic fibers as an aqueous emulsion having a concentration of about 2 to about 30 percent, preferably about 5 to about 15 percent by weight but the lubricants of the invention can also be applied neat. Adequate lubricity can be obtained by providing 0.05 percent to about 3.0 percent, preferably 0.1 percent to about 2 percent by weight of said lubricants based upon the weight of the thermoplastic synthetic fibers. The temperature at which the fibers are heat-treated usually ranges from about 150° C to about 320° C and is preferably about 200° C to about 250° C. The fiber lubricants of the invention provide especially satisfactory lubrication in combination with resistance to oxidation over the temperature range of about 200° C to about 230° C.

The invention is further illustrated by the following specific examples. Where not otherwise specified throughout this specification and claims, temperatures are given in degrees Centigrade and parts, percentages and proportions are by weight.

EXAMPLE 1

In this example, there is disclosed the preparation of a fiber lubricant of the invention wherein a hydroquinone initiated heteric polyol is capped on one end of the polymer with alpha-olefin epoxide.

A hydroquinone-initiated heteric copolymer intermediate having a weight ratio of 63 parts propylene oxide and 37 parts ethylene oxide is prepared by adding 2.2 moles of di-(β-hydroxyethyl)hydroquinone to an autoclave equipped with temperature, pressure and vacuum controls. The autoclave was pressurized with nitrogen to a pressure of 1 atmosphere and the hydroquinone derivative was melted by heating the autoclave to a temperature of 105°-110° C. There was then added to the autoclave 10 grams of a 90 percent by weight potassium hydroxide aqueous solution and the system was heated to 125° C and the autoclave evacuated to a vacuum of less than 10 millimeters of mercury. The autoclave was repressurized with nitrogen and the mixture of 25.8 moles of propylene oxide and 15.6 moles of ethylene oxide was added over a period of approximately 6 hours. The reaction was allowed to continue an additional 2 hours at a temperature of 125° C to ensure complete reaction. The polyoxyalkylated intermediate which was obtained had a hydroxyl number of 95.5 and contained the equivalent of 0.4% potassium hydroxide by weight.

A fiber lubricant of the invention was prepared by reacting the above prepared polyoxyalkylated intermediate with 1,2-epoxy tetradecane according to the following procedure.

The polyoxyalkylated intermediate in the amount of 0.33 moles was added to a 3-liter flask equipped with stirring machine, distillation head, condenser, temperature measuring equipment and heating mantle. The mixture was heated to 100° C under nitrogen atmosphere and then 0.1 mole of sodium methoxide was added and the flask was evacuated to a vacuum of less than 1 millimeter of mercury over a period of 1 hour. After adding 0.35 moles of 1,2-epoxy tetradecane, the flask was evacuated to a vacuum of about 10 millimeters of mercury over a period of 1 hour at a temperature of 100° C. The vacuum was then broken and the reaction continued under a nitrogen atmosphere over a period of 5 hours at a temperature of 130° C. The flask was again evacuated to a vacuum of less than 1 millimeter of mercury over a period of 1 hour. The product was neutralized using acetic acid and the flask evacuated for an additional 30 minutes at 130° C at 1 millimeter of mercury to remove all volatiles. The resulting product contained 0.024 percent by weight oxirane oxygen, had an acid number of 0.82 and an alkalinity number of 1.41. (Theoretically, 1.19% oxirane oxygen would have been found if no reaction had taken place.)

EXAMPLE 2

A hydroquinone-initiated heteric copolymer intermediate was prepared according to the procedure of Example 1. Utilizing this heteric polymer, a fiber lubricant of the invention was prepared in accordance with the procedure of Example 1 by the reaction of 1 mole of alpha-olefin epoxide blend sold under the trademark "VIKOLOX 11-14" by the Viking Chemical Company and 1 mole of the above-described hydroquinone-initiated heteric polymer. A 50 percent by weight aqueous solution of potassium hydroxide was added as catalyst rather than the sodium methoxide used in Example 1 and neutralization of the product was obtained by deionization instead of by the addition of acetic acid as in Example 1. The "VIKOLOX 11-14" is a blend of alpha-olefin epoxides having an average molecular weight of approximately 191 and carbon atom chain lengths of 11 to 14. The product obtained has an oxirane oxygen of 0.02 percent by weight, a hydroxyl number of 84.3 and an alkalinity number of 0.0.

EXAMPLE 3

Utilizing the alpha-olefin epoxide blend of Example 2, a fiber lubricant of the invention was prepared by reaction of 1 mole of said blend with 1 mole of a bisphenol A initiated block polymer intermediate containing approximately 54 percent by weight poly(propylene oxide) and 46 percent by weight poly(ethylene oxide).

The bisphenol A initiated block polymer intermediate was prepared as follows. A clean, dry nitrogen-filled reactor was charged with 18.6 pounds of bisphenol A. 0.9 pounds of sodium methoxide and the mixture was heated with stirring for 30 minutes to a temperature of 125° C. The reactor was evacuated for 30 minutes, the vacuum relieved with nitrogen to a pressure of 2 pounds per square inch gauge and 123.2 pounds of propylene oxide was added at a rate of approximately 50 pounds per hour. After reacting for 3 hours, the reactor was evacuated to less than 10 millimeters of mercury, heated to 135° C and stripped for 10 minutes. The vacuum was again relieved with nitrogen and 107 pounds of ethylene oxide was added at the rate of approximately 50 pounds per hour while maintaining the temperature at 135° C. Subsequently, the mixture was reacted for 2 hours and base catalyst removed by deionization to give the bisphenol initiated block polymer intermediate desired having a hydroxyl number of 40.

A fiber lubricant of the invention was prepared by reacting this polymer intermediate with the alpha-olefin epoxide blend of Example 2, following the procedure as set forth in Example 2, to obtain a product in which the equivalent of 1 mole of alpha-olefin epoxide blend was added to said polymer intermediate. The product contained 0.01 percent by weight of oxirane oxygen and had a hydroxyl number of 37.7.

EXAMPLE 4 (Control)

This example illustrates the preparation of a product obtained by reacting a polyalkylene oxide block polymer with the alpha-olefin epoxide blend of Example 2 in which the polyalkylene oxide block polymer contains no aromatic initiator. A commercially obtained poly(ethylene oxide)/poly(propylene oxide) block polymer having a molecular weight of 2900 was added in the amount of 0.33 moles to a round bottom reaction flask equipped with stirrer, distillation head, condenser, and temperature control. The contents of the flask was heated to 100° C under a nitrogen atmosphere and then 0.09 moles of a 50 percent by weight aqueous solution of potassium hydroxide was added and the mixture evacuated to a vacuum of less than 1 millimeter of mercury for 1 hour. The equivalent of 0.33 moles of the alpha-olefin epoxide blend of Example 2 was then added and the distillation head replaced with a reflux condenser. After refluxing for 2½ hours at 130° C and subsequently 2½ hours at 150° C, the product was stripped under conditions of 150° C and 1 millimeter of mercury. The base catalyst was removed by deionization. The resulting product contained 0.01 percent by weight of oxirane oxygen and had a hydroxyl number of 38.8.

EXAMPLE 5 (Control)

This is a prior art fiber lubricant which is the polyoxyalkylene heteric copolymer intermediate prepared in Example 1 having a hydroxyl number of 95.5 and containing 0.4 percent potassium hydroxide by weight.

Using 125 denier, partially oriented polyester yarn, coated with 1.75 percent by weight (based on the weight of the yarn) of this prior art lubricant, lubricity was evaluated by determining the coefficient of friction using a Rothschild F-meter as described herein. Results show 0.92 as the coefficient of friction at 100 meters per minute, 0.93 at 200 meters per minute and 0.93 at 300 meters per minute tension speed.

EXAMPLE 6 (Control)

Using procedures known to those skilled in the art a polyoxyalkylene fiber lubricant of the prior art was prepared which is a stearic acid initiated heteric polymer formed by reacting 75 parts by weight ethylene oxide and 25 parts by weight propylene oxide using stearic acid as initiator and base catalysis. The apparatus and reaction conditions are similar to those described in Example 1. A final product was obtained after deionization having a molecular weight of about 1400, a hydroxyl number of 40.7, an acid number of 0.708 and 19.2 parts per million sodium ion and 3 parts per million potassium ion.

EXAMPLE 7 (Control)

Refined coconut oil, a fiber lubricant of the prior art, sold under the trademark "COBBE 76" and having a typical analysis as follows: iodine value 9, saponification value 255, lauric acid 48 percent by weight and saturated fatty acid 8 percent by weight.

EXAMPLE 8 (Control)

The fiber lubricant of the prior art, as described in Example 6, was blended with 1 percent by weight of a phenol condensation product, sold under the trademark "TOPANOL CA" by ICI United States, Incorporated, based upon 100% by weight of the fiber lubricant of the Example 6.

EXAMPLE 9

A mixture of the fiber lubricant of the invention described in Example 2 with the fiber lubricant of the prior art described in Example 6 was prepared by mixing equal parts by weight of these components.

EXAMPLE 10

A mixture of the fiber lubricant of the invention described in Example 2 with the prior art fiber lubricant described in Example 6 was prepared by blending these materials in the ratio by weight, respectively, of 1:3.

EXAMPLES 11 and 12

The procedure and proportions of Example 1 are repeated, substituting respectively resorcinol and catechol for hydroquinone to prepare fiber lubricants of the invention.

EXAMPLES 13 and 14

The procedure and proportions of Example 2 are repeated utilizing respectively the resorcinol initiated polymer and the catechol initiated polymer prepared in Examples 11 and 12 to prepare fiber lubricants of the invention.

EXAMPLE 15

The preparation of a fiber lubricant of this invention consisting of the reaction product of one mole of 1,2-epoxytetradecane plus one mole of a hydroquinone-initiated heteric polyoxyalkylene copolymer having a weight ratio of 25% propylene oxide and 75% ethylene oxide is described.

A polyoxyalkylene copolymer intermediate was prepared by the method described for the preparation of the intermediate of Example 1. A weight ratio of 25% propylene oxide and 75% ethylene oxide was used.

The fiber lubricant was made by reacting one mole of the above intermediate with one mole of 1,2-epoxytetradecane by the same method used to prepare Example 4 except that the product was heated at 150° C for five hours.

The product was then stripped for one hour at 150° C and a pressure of less than 1 millimeter mercury, deionized to remove base catalyst and finally, stripped one hour at 125° C and less than 1 millimeter mercury pressure.

Upon evaluating the lubricants of the invention described in Examples 1–7 for resistance to discoloration upon exposure to oxides of nitrogen by the test method of the American Association of Textile Chemists and Colourists, No. 75-1956, entitled "Colorfastness to Oxides of Nitrogen in the Atmosphere: Rapid Control Test", it was found that in most cases no color development occurred where nylon fabric was treated with the lubricants of the invention in the amount of approximately 1% add-on by weight based upon the weight of the fabric. When so evaluated the lubricants described in Examples 1, 3, 4 and 5 show no color development while the lubricant of Example 2 showed slight discoloration and the lubricant of Example 8 which is a control representing a lubricant of the prior art stabilized with a commercial antioxidant showed color development to the extent of dark brown, yellow spots appearing on the fabric under the conditions of the test.

Results are shown in Table I below of an evaluation of the coefficient of friction of lubricated yarn utilizing the fiber lubricant of Example 2 vs. yarn with no lubricant. In the procedure utilized to obtain a value for the coefficient of friction, approximately 1500 meters of yarn are passed over a satin-chrome pin of a Rothschild F-meter in obtaining the *f* value. The Rothschild F-meter has means for maintaining a set tension on yarn being evaluated for lubricity. The coefficient of friction (*f* value) is measured directly by reading the chart produced during evaluation of the yarn. Thus at a speed of 300 meters per minute, the evaluation to determine the coefficient of friction would be carried out over a period of about 5 minutes to obtain the average *f* value from the instrument chart. At slower speeds the evaluation would be carried out over a proportionately longer time to obtain the value for the coefficient of friction.

Table I

FRICTIONAL PROPERTIES OF LUBRICANTS (0.6% by Weight Add-On)

| Example | Tension Speed Meters/Min. | Coefficient of Friction (F)[1] |
|---|---|---|
| Control (no lubricant) | 100 | 0.66 |
| | 200 | 0.70 |
| | 300 | Yarn Breaks |
| 2 | 100 | 0.65 |
| | 200 | 0.67 |
| | 300 | 0.69 |

[1]Rothschild F-Meter

Heat stability was determined by the method of thermogravimetric analysis which includes determining weight loss upon heating portions of the lubricants of the invention under dynamic, i.e., progressively increasing heat conditions and isothermal conditions. The thermogravimetric analysis results of Table II below indicate the superior oxidative stability of the lubricants of the invention as compared to the control prior art lubricant polyoxyalkylated compound which does not contain an aromatic nucleus in the polymer chain. In comparison with control sample 6 which is an alkoxylated heteric fatty acid composition which is well known as a lubricant in the prior art for spin-finish application, the lubricants of the invention show a marked increase in oxidative stability. As illustrated by the results obtained in Table II, the lubricants of Examples 9 and 10 indicate that the lubricant of the invention disclosed in Example 2 can be used in a minor amount in the mixtures with the lubricant of the prior art disclosed in Example 6 to improve oxidative stability of the total mixture.

Table II

HEAT STABILITY OF FIBER LUBRICANTS

| | Thermogravimetric Analysis | | | | |
|---|---|---|---|---|---|
| | Dynamic | | Isothermal | | Residue |
| | ° C at Wt. Loss of | | % Wt. Loss at 220° C | Smoke Point | 8 hrs. at 220° C |
| Example | 1% | 10% | ½ hr. | (° C) | % by Wt. |
| 1 | 261 | 330 | 1.5 | 220 | 43 |
| 2 | 264 | 320 | 6.9 | 212 | 38 |
| 3 | 233 | 289 | 25.0 | 180 | 4.4 |
| 4 | 202 | 248 | 91.5 | 166 | 0.0 |
| 6 | 228 | 268 | 31.5 | 177 | 0.4 |
| 7 | 278 | 330 | — | — | 21.7 |
| 8 | 297 | 373 | — | — | — |
| 9 | — | — | 8.8 | — | — |
| 10 | — | — | 11.9 | — | — |

The oxidative stability of the lubricants of the invention disclosed in Examples 1 and 2 is significantly better than that shown by the lubricant disclosed in Example 3. While not wishing to be bound by theory, it is believed that this result is obtained because of two factors. The lubricant of Example 3 has almost double the molecular weight of the lubricants of Examples 1 and 2. Thus, the effective concentration of the diphenolic nucleus is approximately half that of the lubricants of Examples 1 and 2. In addition, the hydroquinone structure in Examples 1 and 2 is apparently more effective in imparting oxidative stability than a bisphenol structure on the basis that resonance between the two hydroxyl groups cannot occur in the bisphenol structure while it can occur in hydroquinone structure. It is believed that the improved smoke point of Example 1 as compared to Example 2, as shown in Table I, can be explained on the basis that the method of neutralization of the polyoxyalkylene compound intermediate utilized in the preparation of the lubricant differs; in Example 1 neutralization being accomplished by the use of acetic acid while in Example 2 neutralization is accomplished by deionization.

While this invention has been described with reference to certain specific embodiments, it will be recognized by those skilled in the art that many variations are possible without departing from the scope and spirit of the invention.

The embodiment of the invention in which an exclusive property or privilege is claimed are defined as follows:

1. A lubricant for thermoplastic fibers comprising a block or heteric copolymer polyoxyalkylene composition having the formula:

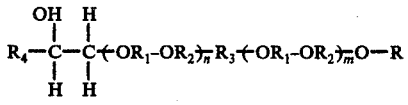

wherein $n + m$ has a value to produce a molecular weight of about 300 to about 3000; R is selected from the group consisting of hydrogen, the residue of an aliphatic monocarboxylic acid having 1 to about 24 carbon atoms,

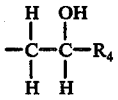

and mixtures thereof; $R_1$ and $R_2$ are the same or different and derived from lower alkylene oxides selected from the group consisting of ethylene oxide, 1,2-propylene oxide and butylene oxide; $R_3$ is a divalent radical derived from a difunctional aromatic compound containing at least two active hydrogens and $R_4$ is an alkyl radical having about 1 to about 22 carbon atoms.

2. The composition of claim 1 wherein $R_3$ is derived from a dihydroxyphenol.

3. The composition of claim 2 wherein said lubricant is a block copolymer of ethylene oxide and 1,2-propylene oxide and $R_3$ is derived from bisphenol A.

4. The composition of claim 2 wherein $R_3$ is derived from hydroquinone.

5. The composition of claim 2 wherein $R_3$ is derived from resorcinol.

6. The composition of claim 2 wherein $R_3$ is derived from catechol.

7. The composition of claim 1 wherein said polyoxyalkylene composition is a heteric mixture of lower alkylene oxides selected from the group consisting of ethylene oxide and 1,2-propylene oxide wherein the weight ratio of ethylene oxide to 1,2-propylene oxide is 90:10 to 10:90.

8. The composition of claim 7 wherein said polyoxyalkylene composition is a heteric mixture of 25 percent by weight 1,2-propylene oxide and 75 percent by weight ethylene oxide.

9. A fiber lubricant for thermoplastic fibers comprising a heteric or block copolymer polyoxyalkylene composition having the formula:

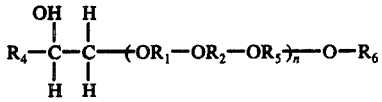

wherein $R_1$ and $R_2$ are the same or different lower alkylene oxide units derived from alkylene oxides selected from the group consisting of ethylene oxide, 1,2-propylene oxide, butylene oxide and mixtures thereof; $R_4$ is an alkyl group having about 1 to about 22 carbon atoms; $R_5$ is derived from at least one aromatic glycidyl ether; $R_6$ is selected from the group consisting of hydrogen, the residue of an aliphatic monocarboxylic acid having 1 to about 24 carbon atoms, an aliphatic alcohol,

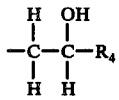

and mixtures thereof, and $n$ has a value to produce a molecular weight from about 300 to about 3000.

10. The composition of claim 9 wherein said aromatic glycidyl ether has up to about 6 carbon atoms in the alkyl group.

11. The composition of claim 10 wherein said aromatic glycidyl ether is phenyl glycidyl ether.

12. A fiber lubricant for thermoplastic fibers comprising a mixture of a first heteric or block copolymer polyoxyalkylene composition selected from at least one of the group consisting of

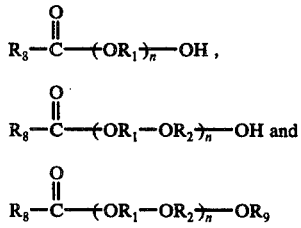

wherein $R_8$ is an alkyl group having about 7 to about 24 carbon atoms, $R_9$ is an alkyl or acyl group having 1 to about 22 carbon atoms, $R_1$ and $R_2$ are the same or different lower alkylene oxide units derived from ethylene oxide, 1,2-propylene oxide and butylene oxide and $n$ is of a value to produce a molecular weight of about 300 to about 3000 and at least 25 percent by weight of a second heteric or block copolymer polyoxyalkylene composition selected from at least one of the group consisting of:

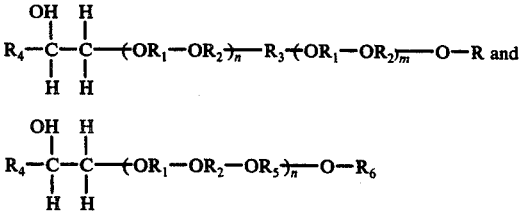

and wherein R is selected from the group consisting of hydrogen, the residue of an aliphatic monocarboxylic acid having 1 to about 24 carbon atoms,

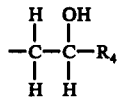

and mixtures thereof; $R_1$ and $R_2$ are the same or different and derived from lower alkylene oxides selected from the group consisting of ethylene oxide, 1,2-propylene oxide, butylene oxide and mixtures thereof; $R_3$ is the residue of a dihydroxyphenol; $R_4$ is an alkyl group having 1 to 22 carbon atoms; $R_5$ is the residue of at least one aromatic glycidyl ether; $R_6$ is selected from the group consisting of hydrogen, the residue of an aliphatic monocarboxylic acid having 1 to about 24 carbon atoms, the residue of an aliphatic alcohol,

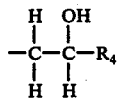

and mixtures thereof; and $n$ or $n + m$ has a value to produce a molecular weight from about 300 to about 3000.

13. The composition of claim 12 wherein $R_3$ is bisphenol A.

14. The composition of claim 12 wherein $R_3$ is di-($\beta$-hydroxyethyl)hydroquinone.

15. The process for inhibiting the oxidation of a polyoxyalkylene composition upon exposure to heat comprising maintaining in said compound at least about 25 percent by weight of the composition of claim 1.

16. The process for inhibiting the oxidation of a polyoxyalkylene composition upon exposure to heat comprising maintaining in said composition at least about 25 percent by weight of the composition of claim 9.

17. A lubricated fiber comprising the composition of claim 1 and a thermoplastic fiber.

18. The article of claim 17 wherein said fiber is a polyamide or polyester.

19. A lubricated fiber comprising the composition of claim 9 and a thermoplastic fiber.

20. The article of claim 19 wherein said fiber is a polyamide or polyester.

21. A lubricated fiber comprising the composition of claim 12 and a thermoplastic fiber.

22. The article of claim 21 wherein said fiber is a polyamide or polyester.

* * * * *